United States Patent [19]

Holcomb et al.

[11] Patent Number: 4,838,708

[45] Date of Patent: Jun. 13, 1989

[54] SECURITY DEPOSIT BAG

[75] Inventors: Bruce A. Holcomb, Stillwater; Shaun D. McCracken, Oakdale; Bryan J. McGinnis, Birchwood Village, all of Minn.

[73] Assignee: Minnesota Mining and Manufacturing Company, St. Paul, Minn.

[21] Appl. No.: 159,431

[22] Filed: Mar. 7, 1988

[51] Int. Cl.[4] ..... B65D 33/14

[52] U.S. Cl. ..... 383/5; 383/84; 229/102; 206/807

[58] Field of Search ..... 383/5, 84; 229/102; 206/807

[56] References Cited

U.S. PATENT DOCUMENTS

| | | | |
|---|---|---|---|
| 2,899,347 | 8/1959 | Kindseth | 154/102 |
| 2,949,370 | 8/1960 | Hughes | 99/173 |
| 2,991,001 | 7/1988 | Hughes | 229/62 |
| 3,085,738 | 4/1963 | Bok | 229/62 |
| 3,256,941 | 6/1966 | Rivman | 229/62 |
| 3,339,337 | 9/1967 | Rapp et al. | 53/180 |
| 3,381,592 | 5/1968 | Ravel | 93/8 |
| 3,473,589 | 10/1969 | Gotz | 150/3 |
| 3,655,503 | 4/1972 | Stanely et al. | 161/165 |
| 3,925,584 | 12/1975 | Suzuki et al. | 428/40 |
| 4,228,900 | 10/1980 | Lambach et al. | 206/260 |
| 4,464,158 | 8/1984 | Kardon | 383/84 |
| 4,468,811 | 8/1984 | Shaw et al. | 383/5 |
| 4,483,018 | 11/1984 | Whelan | 383/5 |
| 4,543,139 | 9/1985 | Freedman et al. | 156/152 |
| 4,557,505 | 12/1985 | Schaefer et al. . | |
| 4,574,098 | 3/1986 | Sampson | 428/40 |
| 4,640,727 | 2/1987 | Janssen | 156/240 |
| 4,652,473 | 3/1987 | Han | 428/35 |
| 4,706,396 | 11/1987 | Voshall et al. | 383/5 |
| 4,759,968 | 7/1988 | Janssen | 428/202 |
| 4,759,982 | 7/1988 | Jenssen et al. | 428/343 |

FOREIGN PATENT DOCUMENTS

| | | | |
|---|---|---|---|
| 148030 | 7/1985 | European Pat. Off. | 383/5 |
| 83/00705 | 11/1983 | PCT Int'l Appl. . | |
| 1380727 | 1/1975 | United Kingdom . | |
| 2051003 | 3/1983 | United Kingdom . | |
| 2120638 | 12/1983 | United Kingdom . | |
| 2145997 | 4/1985 | United Kingdom . | |

OTHER PUBLICATIONS

Scotch TM Protected Graphic Systems, pp. 1–8, undated.

*Primary Examiner*—Willis Little

*Attorney, Agent, or Firm*—Donald M. Sell; Walter N. Kirn; Leland D. Schultz

[57] ABSTRACT

A security deposit bag for receipt of articles and including adhesive closure means for releasably enclosing the opening of the bag. The adhesive closure means includes means for forming indicia in the adhesive closure means if the bag is opened after being sealed.

21 Claims, 5 Drawing Sheets

SECURITY DEPOSIT BAG

TECHNICAL INVENTION

This invention relates generally to bags and more particularly to bags for secure deposit of articles.

BACKGROUND ART

Security deposit bags have been devised in the past to securely store and transport valuable articles such as documents, including cash and currency, checks, jewelry, bank deposits, securities, criminal investigation evidence and the like. Such security deposit bags include bags or envelopes constructed from sewn fabric, plastic film, or laminates thereof with a zippered closure. The zippered closure may be secured with a lock or seal. However, such conventional security deposit bags are bulky, expensive, and although enable reuse, also generate a recurring expense in transporting the security deposit bag back to the sender for reuse.

Security deposit bags have also been developed that are constructed of disposable material and that are adhesively secured and sealed. U.K. Patent No. GB 2145997A entitled "Tamperproof Bag" and issued to Interpoly Limited, illustrates one such design and includes a bag constructed of polyethylene. An adhesive strip is applied to an inside surface of the bag adjacent the opening and is temporarily covered by a liner. Once the bag has been filled, the liner is removed and the bag sealed by the adhesive strip. The bond of the adhesive strip exceeds the strength of the plastic film used to construct the bag. Any unauthorized attempt to open the bag will result in destruction or visible distortion of the bag material, thus indicating that the bag has been opened. The security deposit bag disclosed in British Pat. No. 2,145,997, although an improvement over other conventional security deposit bags, still exhibits several undesirable characteristics. Once the bag is reopened by rupturing the material of the bag, whether or not by authorized personnel, the contents of the bag are exposed to environmental conditions. It is then difficult if not impossible to reseal the bag. Further, it is inconvenient to limit the materials used to construct the bag to those having a relatively low strength. A visually perceptible distortion in the bag material is not in itself an unambiguous indication that the bag has been opened. The bag may have been merely subjected to external forces that distorted the bag material.

DISCLOSURE OF INVENTION

The bag includes a first and a second panel joined to form sides and bottom of the bag. An opening is provided for access to the interior of the bag. Adhesive closure means as adhered to the first panel and is adapted to secure the panels together to close the opening of the bag. The adhesive closure means includes tamper indicating means for creating indicia externally of the bag after the adhesive closure means has adhesively secured the panels together and the panels are then separated to open the bag.

Thus, a security deposit bag is provided that is inexpensive, disposable and includes an adhesive closure means that provides an unambiguous indication externally of the bag, if the bag has been sealed and reopened.

BRIEF DESCRIPTION OF DRAWING

The present invention will be further described with reference to the accompanying drawing wherein like reference numerals refer to like parts in the several views, and wherein.

DETAILED DESCRIPTION

Figure 1:
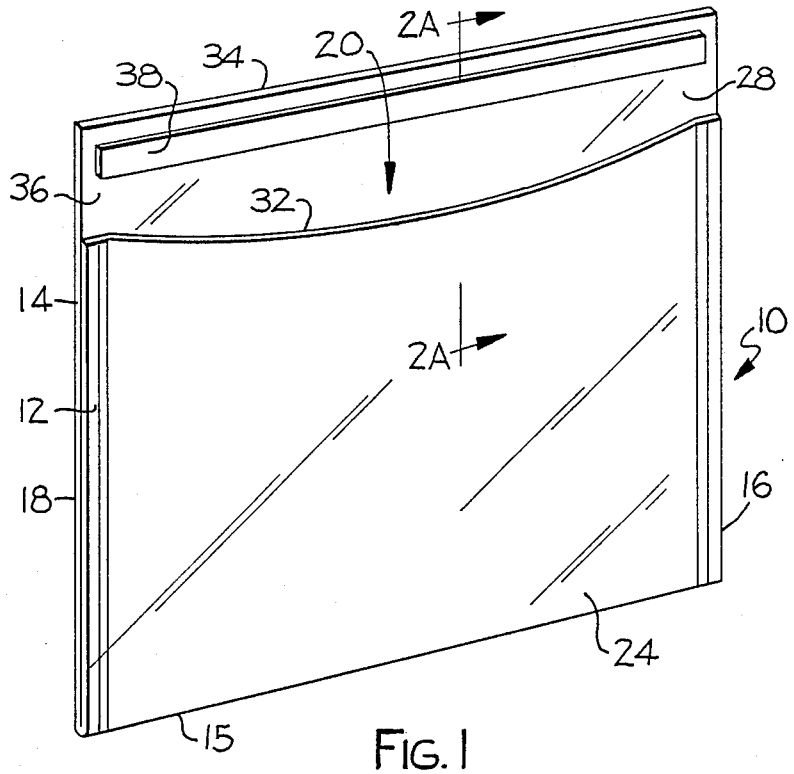
FIG. 1 is an isometric view of a security deposit bag constructed according to this invention with an adhesive closure strip adhered to the front surface of the rear panel.
Figure 2A:
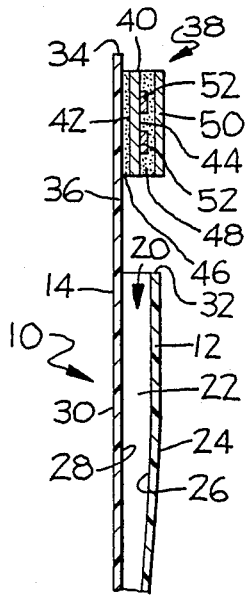
FIG. 2A is a cross sectional view along plane 2A—2A of FIG. 1.

Referring now to FIG. 1, the reference numeral 10 generally indicates a security deposit bag constructed according to the present invention. The security deposit bag in the illustrated embodiment takes the form of a flexible bag, envelope or the like, constructed of a strong, lightweight plastic material such as polyethylene, polypropylene, polyethylene terephthalate, polyvinylchloride, polyvinylidinechloride, vinyl acetate, multilayer films of these and other polymers and copolymers, copolymers of the above materials and others, metal foils, paper and paper-like materials, multilayer constructions of these and other materials. The container of this invention is efficiently and economically constructed so that it may be considered disposable upon receipt at its intended destination, with the contents of the bag removed. The bag 10 may be formed by folding over a rectangular sheet of material and sealing it along its sides. As is also shown in FIG. 2A, the bag thus formed includes bottom 15, right side 16, left side 18 and opening 20 providing access to interior 22 of the bag. Front panel 12 includes front and rear major surfaces 24 and 26, respectively. Rear panel 14 includes front and rear major surfaces 28 and 30, respectively. Although not shown, bag 10 may also be constructed with side and bottom panels, in addition to the front and rear panels illustrated.

Since the end edge 32 of front panel 12 and end edge 34 of rear panel 14 of the bag are not aligned, flap 36 is formed by a portion of the rear panel. Flap 36 is provided to enclose opening 20 by folding the front surface 28 of the rear panel over into contact with front surface 24 of front panel 12.

Adhesive closure means are provided to adhesively secure the rear panel 14 to the front panel 12 so as to enclose the opening 20. In the illustrated embodiment, the adhesive closure means includes laterally extending adhesive closure strip 38 adhered to the front surface 28 of the rear panel 14 and more specifically to flap 36.

The closure strip 38 includes a film backing strip 40 having opposing first and second major surfaces 42 and 44. The following is a non-exclusive list of materials suitable for use as the film backing strip: cellulose acetate, polyethylene, polypropylene, polyethyleneterephthalate, polyvinyl chloride, copolymers, multilayer composites of polymers and/or copolymers.

A first layer of adhesive 46 is applied to the first major surface 42 of the film backing strip 40. The first layer of adhesive 46 adheres the film backing strip 40 to the front surface 28 of the rear panel 14. The adhesive may be of any type found suitable, such as a solvent or heat activatable, or a pressure sensitive adhesive. The following is a non-exclusive list of adhesives suitable for use as the first layer of adhesive: styrene-isoprene and/or styrene butadiene elastomers with hydrocarbon and/or terpene tackifiers, synthetic or natural rubbers with tackifiers, acrylic polymers with or without tackifiers, ethylene-acrylic acid copolymers, ethylene-vinyl acetate copolymers, and polyethylene.

Second layer of adhesive 48 is applied to the second major surface 44 of the film backing strip. As in the case of the first adhesive layer 46, the second layer of adhesive 48 may be of any type found suitable, such as a solvent or heat activatable adhesive or, the second layer of adhesive 48 may be a pressure sensitive adhesive. The following is a non-exclusive list of adhesives suitable for use in forming the second layer of adhesive: styrene-isoprene and/or styrene butadiene elastomers with hydrocarbon and/or terpene tackifiers, synthetic or natural rubbers with tackifiers, acrylic polymers with or without tackifiers, ethylene-acrylic acid copolymers, ethylene-vinyl acetate copolymers, and polyethylene.

Figure 2B:
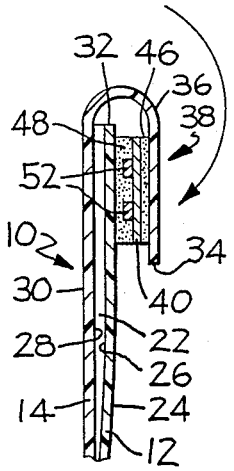
FIG. 2B is a cross sectional view of the portion of the security deposit bag in FIG. 2A with the rear panel secured to the front panel by the closure strip.
Figure 3:
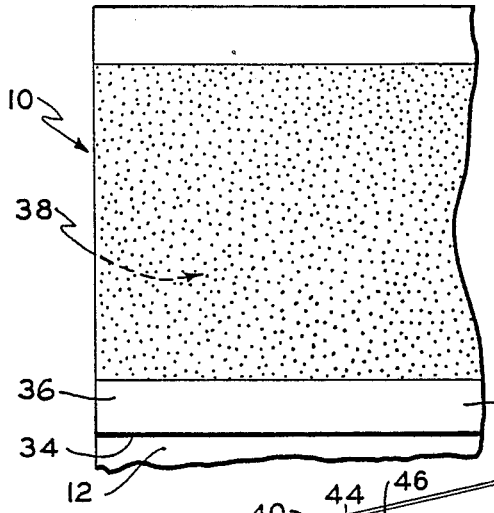
FIG. 3 is a front view of a portion of the security deposit bag of FIG. 2B.

In the illustrated embodiment of the invention, the second layer of adhesive 48 is a pressure sensitive adhesive. Therefore, liner 50 is releasably adhered to the second layer of adhesive 48 opposite the film backing strip 40 and is coextensive with the second layer of adhesive. The liner 50 may be constructed of any material suitable for use with the particular adhesive applied to the second major surface of the film backing strip such as a silicone applied paper or plastic film. As is shown in FIGS. 2B and 3, the liner 50 may be removed and the rear panel 14 secured to the front panel 12 of the bag by applying the exposed second layer of adhesive 48 to the front surface 24 of the front panel 12 so that the flap 36 encloses opening 20.

For purposes of security, it is desirable to minimize the "dwell time" required for the second layer of adhesive to develop a sufficiently high bond strength to the surface to which it is applied. Preferably, the dwell time is no greater than 0–15 seconds. This precludes or minimizes the risk of undetected opening of the bag prior to the attainment of ultimate bond strengths of the closure strip to the panels. The dwell time may also be reduced by treating the surface to which the closure strip is to be adhered, such as by a corona or chemical treatment.

The adhesive closure means includes tamper indicating means for forming indicia providing an unambiguous indication perceptible externally of the bag that the bag has been sealed and reopened. In the illustrated embodiment of the invention, the tamper indicating means includes a layer of low adhesion material 52 applied to the second major surface of the film backing strip prior to the application of the second layer of adhesive 48 thereon. The low adhesion material is applied to the film backing strip in a desired pattern of recognizable indicia, such as spaced undulating stripes shown in FIG. 5 extending longitudinally along the film backing strip. The layer of low adhesion material is substantially less thick than the second layer of adhesive.

The low adhesion material is applied to the film backing strip so as to assume an intimate surface to surface contact with the surface of the film backing strip. In the illustrated embodiment, the low adhesion material 52 is applied to the film backing strip 40 in a liquid state and solidifies in intimate surface-to-surface contact with the second major surface thereof. However, the low adhesion material may be applied in a flowable state or in the form of a powder, if it forms an intimate surface to surface contact with the film backing strip.

The following is a non-exclusive list of materials suitable for use as the low adhesion material: hydroxypropylcellulose, polyvinyl alcohol, polyvinylpyrrolidone, polyvinylacetate, mixtures and/or copolymers of these materials and others.

The materials of the bag, film backing strip, first and second layer of adhesive, and low adhesion material are selected so that the relative strengths of adhesion of the various materials exhibit desired relationships. The first layer of adhesive must adhere more aggressively to the rear panel and the first major surface of the film backing strip than the second layer of adhesive adheres to the front panel and the second major surface of the film backing strip. The second layer of adhesive must adhere more aggressively to the layer of low release material than the layer of low adhesion material adheres to the second major surface of the film backing strip. These relationships may also be facilitated by selecting different adhesives for use in the first and second layers of adhesive, or by treating the areas on the front and rear panels that the closure strip 38 is to be adhered to, such by with a corona treatment or chemical treatment so as to selectively control the relative bonding strengths of the first and second layers of adhesives to the front and rear panels.

Figure 2C:
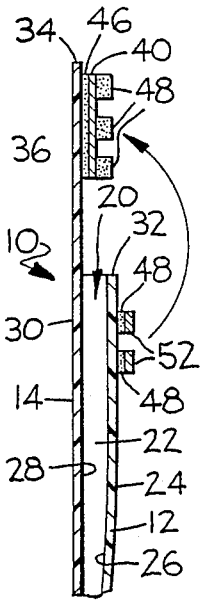
FIG. 2C is a cross sectional view of the security deposit bag of FIG. 2B with the rear panel detached from the front panel.
Figure 4:
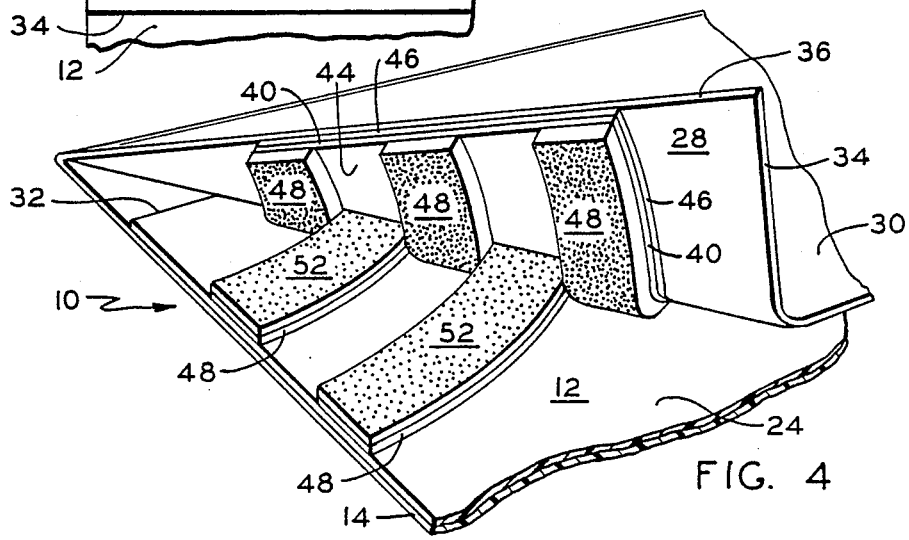
FIG. 4 is a front view of the portion of the security deposit bag of FIG. 3 in which the rear panel has been secured to the front panel and then partially detached.

As shown in FIGS. 2C and 4, after being adhesively secured by the closure strip 38, the rear panel 14 may be detached or delaminated from the front panel 12. As the rear panel 14 is detached from the front panel 12, the pattern of low adhesion material 52 delaminates from the film backing strip, along with a portion of the second layer of adhesive 48 substantially in alignment with the pattern of applied low adhesion material (i.e., preferably at least 90% of the second layer of adhesive coinciding with the pattern of low adhesion material is delaminated from the film backing strip or at least the minimum amounts necessary to form perceptable indicia). The first layer of adhesive 46, the film backing strip 40, and any remaining portion of the second layer of adhesive 48 not coinciding with the pattern of applied low adhesion material 52 will remain adhered to the flap 36 of the bag.

The exposed surface of the low adhesion material exhibits a substantially different appearance than do adjacent surfaces. Thus, visibly perceptible indica in the form of the pattern of low adhesion material are created.

Figure 5:
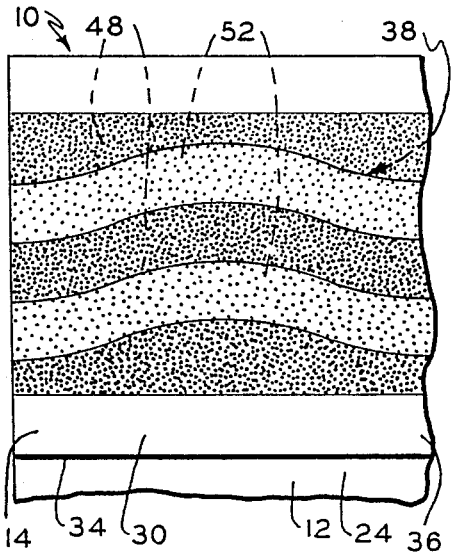
FIG. 5 is a front view of a portion of the security deposit bag of FIG. 4 in which the rear panel has been resecured to the front panel by the closure strip, forming indicia.

If the bag is then opened, for whatever reason, it may be quickly and easily adhesively resealed by the closure strip to protect the contents of the bag from the environment, notwithstanding the indicia created thereby. With the rear panel 14 resecured by the closure strip to the front panel as shown in FIG. 5, the non-aligned portions of the second layer of adhesive 48 will resecure the front surface of the front panel. The solidified low adhesion material 52 will not reconform in intimate surface to surface contact with the second major surface 44 of the film backing strip 40. The portions of the second layer of adhesive that don'oincide with the pattern of low adhesion material, however, will resume their original configuration and appearance. A visual discontinuity is created by the space and air trapped between the low adhesion material and the second major surface 44 of the film backing strip as compared to the adjacent portions of the second layer of adhesive in intimate surface to surface contact with the film backing strip. Thus, the indicia formed when the bag 10 was reopened after being secured are visible at the boundaries between the low adhesion material and the non-aligned portions of the second layer of adhesive in the shape of the applied pattern of low adhesion material and the visibility of the indicia is enhanced. It is preferred that the second major surface of the film backing strip be provided with a finish, such as a matte finish, adapted to enhance the contrast of the indicia in the closure strip.

Alternatively, a closure strip may be provided as part of this invention and as in any of the embodiments described herein wherein the second layer of adhesive has greater bond strength to the surface of the bag than to the second major surface of the film backing strip. In this embodiment, the entire second layer of adhesive will be delaminated from the film backing strip along with the pattern of low adhesion material. However, the adhesive closure means functions as hereinabove described when the closure strip is reapplied to secure the front and rear panels together. That is, the exposed, non aligned portions of the second layer of adhesive will adhere to the film backing strip while the pattern of low adhesion material will form indicia when delaminated from the film backing strip.

In order for the indicia to be perceived externally of the bag when the bag is resealed by the closure strip, it is necessary in the illustrated embodiment of the invention for portions of the closure strip 38 and the bag to be light transmissive. That is, portions of the closure strip and bag must be non-opaque (transparent or translucent, and possibly pigmented) so that the interface of the low adhesion material 52 and second layer of adhesive 48 with the film backing strip 40 is visually perceptable. For instance, in regard to the embodiment shown in FIGS. 1, 2A ,2B, and 2C, the first layer of adhesive 46, and the film backing strip 40, must be light transmissive, as well as the flap 36 of the rear panel !4 in at least that portion overlying the closure strip. As shown in FIG. 5, the indicia in the closure strip are perceptible externally of the bag through the flap 36 of the rear panel 14. Alternatively, the bag of FIG. 1 may be constructed so that the front and rear panels 12 and 14 of the bag adjacent the closure strip, the second layer of adhesive 48 and the low adhesion material 52 are light transmissive, so that the indicia in the closure strip are perceptible though the back side of the bag.

Figure 6:
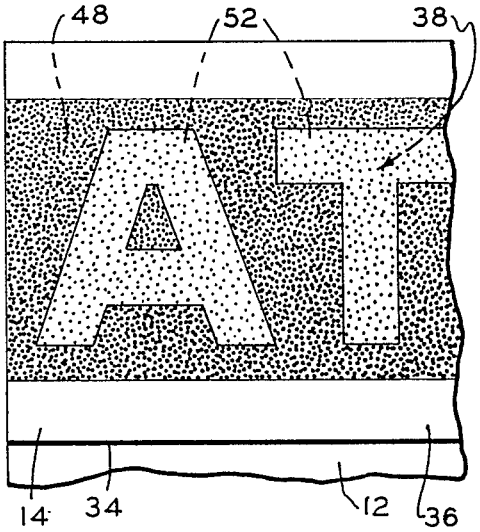
FIG. 6 is an alternative embodiment of the security deposit bag shown in FIG. 5 in which the indicia formed by the closure strip include alphanumeric characters.

FIG. 6 illustrates an alternative embodiment of the invention in which the low adhesion material 52 of the closure strip 38 is applied in a pattern that forms one or more alphanumeric characters. For instance, the pattern may include a warning or message indicating that the bag has been opened.

Figure 7A:
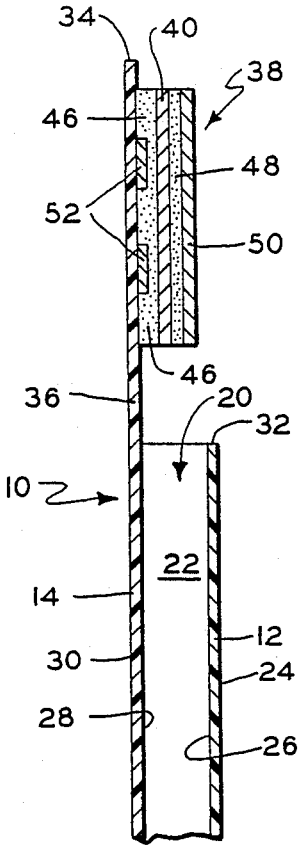
FIG. 7A is a cross sectional view of a portion of a security deposit bag with an alternate embodiment of the closure strip having tamper indicating means formed within the closure strip and adjacent the front surface of the rear panel.
Figure 7B:
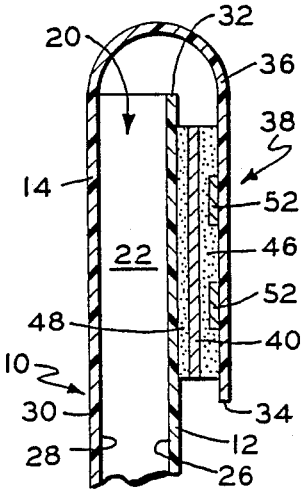
FIG. 7B is a cross sectional view of the security deposit bag of FIG. 7A with the front and first panels secured together by the closure strip.

FIG. 7A illustrates an alternative embodiment of the invention with a security deposit bag constructed as described with respect to FIG. 1. Closure strip 38 is adhered to the front surface 28 of the rear panel 14. The closure strip 38 includes a pattern of low adhesion material 52 applied directly to the front surface 28 of the rear panel 14, as opposed to a surface of the film backing layer as shown in FIGS. 1–2C. The low adhesion material 52 is placed in intimate surface to surface contact with the front surface 28 of the rear panel as previously described. In FIG. 7B, the liner 50 has been removed and the second layer of adhesive 48 applied to the front surface 24 of the front panel 12 to secure the closure strip 38 and enclose the opening 20 of the bag.

Figure 7C:
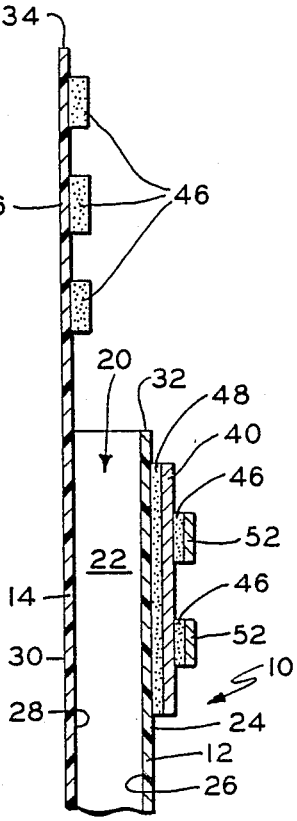
FIG. 7C is a cross sectional view of the security deposit bag of FIG. 7B with the rear panel detached from the panel.

In FIG. 7C, the bag 10 has been opened and the rear panel 14 detached from the front panel 12. However, in this case, the pattern of low adhesion material 52 has delaminated from the front surface 28 of the rear panel along with a portion of the first layer of adhesive 46 substantially in alignment with the pattern of low adhesion material to form the indicia. The remainder of the first layer of adhesive 46 remains on the rear panel.

In this embodiment the relationships of the strengths of the adhesion of the various materials must be varied from that previously discussed in regard to the embodiment in FIGS. 1, 2A, 2B and 2C. Specifically, the second layer of adhesive must adhere more aggressively to the front panel and the second major surface of the film backing strip than the first layer of adhesive adheres to the first major surface of the film backing strip or the rear panel.

If desired, the front and rear panels 12 and 14 may be resecured to each other by the closure strip 38 through the exposed portion of the first layer of adhesive 46 which is not in alignment with the low adhesion material. The indicia are visible at the boundary of the low adhesion material 52 and the front surface of the rear panel. The indicia are perceptible externally of the bag by providing at least a portion of the front and/or rear panel and closure strip light transmissive. In all other respects this embodiment is as described with respect to the embodiment in FIG. 1.

Figure 8:
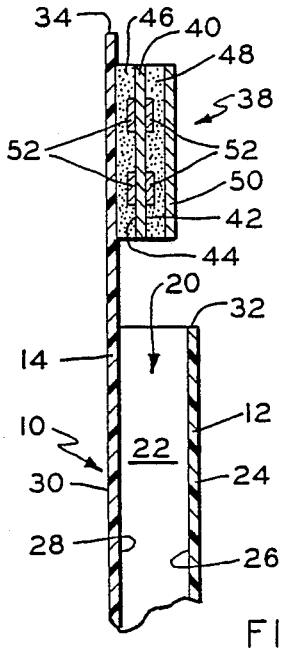
FIG. 8 is a cross sectional view of a portion of a security deposit bag with yet another alternate embodiment of the closure strip adhered to the front surface of the rear panel with tamper indicating means formed on both sides of the closure strip.

In FIG. 8, another alternative embodiment is shown that includes a closure strip 38 and a bag 10 as described in regard to FIG. 1. However, the closure strip includes a pattern of low adhesion material 52 applied to both the first and second major surface 42 and 44 of the film backing strip 40 in a manner previously described so as to be in intimate surface to surface contact with each of the opposing major surfaces of the film backing strip. In this embodiment, the first and second adhesive layers 46 and 48 may have substantially equal bond strengths to the front surface 28 of the rear panel 14 and the front surface 24 of the front panel 12. The closure strip will thus form indicia equally well on either side of the film backing layer responsive to which side of the closure strip is delaminated from the front and rear panels. In this embodiment, it is necessary that the first adhesive layer, second adhesive layer, and portions of the front and rear panels and both patterns of low adhesion material be light transmissive so that the indicia formed by the closure strip are externally perceptible.

Figure 9A:
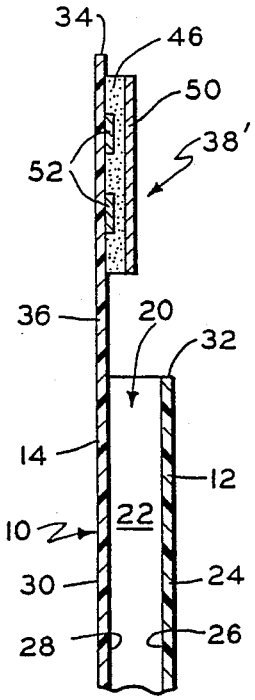
FIG. 9A is a cross sectional view of a portion of a security deposit bag with an alternate embodiment of the closure strip with a single layer of adhesive adhered to the front surface of the rear panel and tamper indicating means formed within the closure strip adjacent the surface of the bag.
Figure 9B:
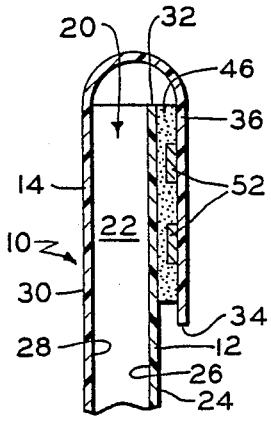
FIG. 9B is a cross sectional view of the security deposit bag of FIG. 9A with the front and first panels secured together by the closure strip.

FIG. 9A illustrates yet another alternative embodiment of the invention in which the closure strip 38' may be formed directly on the front surface of the rear panel, or alternatively separately formed and subsequently applied to a bag, such as in the form of adhesive transfer tape. In FIG. 9A, the second layer of adhesive 48 and the film backing strip 40 have been omitted. Low adhesion material 52 has been applied directly in a desired pattern on the front surface 28 of the rear panel 14. A layer of adhesive 46 is applied over the low adhesion material generally in a transverse strip along the front side of the bag. A releasable liner 50 is applied to the layer of adhesive 46 prior to use. With the liner removed, the rear and front panels are secured together bag by the adhesive layer 46 of the closure strip 38' (as in FIG. 9B).

In this embodiment the layer of adhesive must adhere more aggressively to the rear panel than to the front panel, when adhered thereto. The layer of adhesive must adhere more aggressively to the front panel when adhered thereto, than to the layer of low adhesion material. The layer of adhesive must adhere more aggressively to the layer of low adhesion material than the layer of low adhesion material adheres to the rear panel.

Figure 9C:
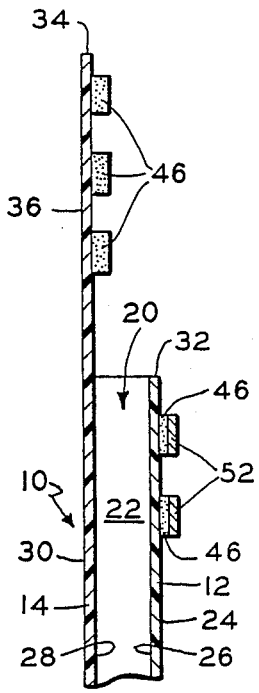
FIG. 9C is a cross sectional view of the security deposit bag of FIG. 9B with the rear panel detached from the front panel.

If detached (as in FIG. 9C) indicia are created by the pattern of low adhesion material, as hereinabove described, and when reapplied, the indicia remain at the interface of the low adhesion material and the front surface of the rear panel. The indicia are perceptible externally of the bag through light transmissive portions of the bag and closure strip as previously described.

Figure 10:
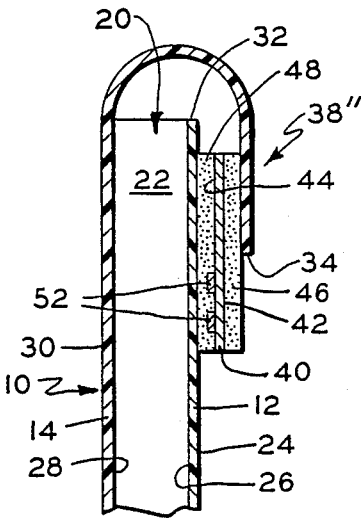
FIG. 10 is a cross sectional view of a portion of a security deposit bag with yet another alternate embodiment of the closure strip with a portion of the closure strip containing the tamper indicating means extending beyond the front and first panels.

FIG. 10 illustrates an alternate embodiment of the invention in which the front and rear panels 12 and 14 of the bag may be opaque. A closure strip 38" is provided to secure the rear panel 14 to the front panel 12 of the bag and includes film backing strip 40 that extends beyond edge 34 of the rear panel. The second layer of adhesive is preferably a pressure sensitive adhesive and is covered by a releasable liner (not shown) prior to use. The first layer of adhesive is, however, preferably a non-tacky adhesive, such as a solvent or heat activatable adhesive. The film backing strip 40 extends beyond the edge of the rear panel so that a portion of the first layer of adhesive 46 is exposed. Indicia may be formed by applying the second layer of adhesive 48 to the front panel to secure the front and rear panels together then delaminating the closure strip from the front panel. The indicia are perceptible externally of the bag, such as through a light transmissive portion of the film backing strip 40 and first layer of adhesive 46 extending beyond the edge of the rear panel.

Figure 11:
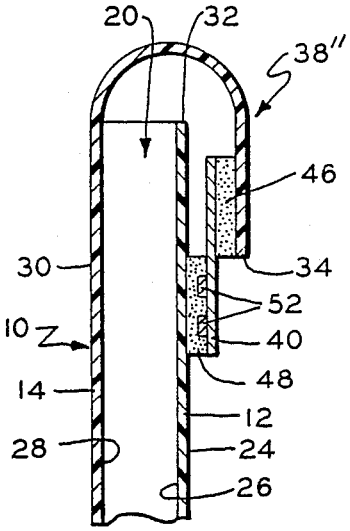
FIG. 11 is a cross sectional view of a portion of a security deposit bag with yet another alternate embodiment of the closure strip of FIG. 10 with portions of the layers of adhesive removed from the closure strip.

FIG. 11 illustrates an alternative embodiment of the bag 10 and closure strip 38" of FIG. 10 in which a portion of the first layer of adhesive 46 adjacent the rear panel and a portion of the second layer of adhesive 48 extending beyond edge 34 of the rear panel 14 have been omitted. In all other respects this embodiment of the invention is as hereinabove described. Specifically, in the embodiments of the invention shown in FIGS. 10 and 11, the relationship of the various strengths of adhesion are as described with respect to the embodiment shown in FIGS. 1, 2A, 2B, 2C and as discussed hereinabove.

Figure 12:
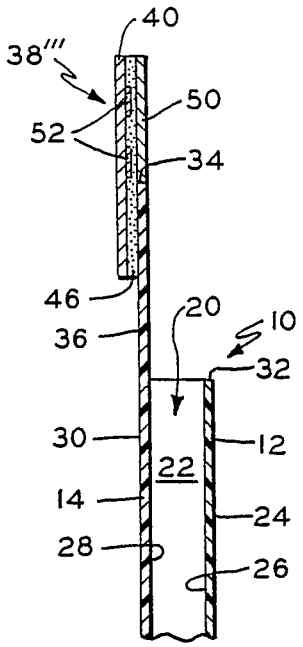
FIG. 12 is a cross sectional view of a security deposit bag with yet another alternate embodiment of the closure strip adhered to the back surface of the rear panel with the closure strip extending beyond the front and first panels and a portion of the layer of adhesive exposed.

FIG. 12 illustrates yet another embodiment of the security deposit bag of this invention, in which the closure strip 38''' is adhered to the rear surface 30 of the rear panel 14. Film backing strip 40 has a first layer of adhesive 46 applied to the first major surface 42. Preferably, the first layer of adhesive is a pressure sensitive adhesive, with a portion of the film backing strip and the first layer of adhesive extending beyond the rear panel. The portion of the first layer of adhesive 46 extending beyond the rear panel contains the tamper indicating means in the form of the pattern of low adhesion material 52. A removable liner 50 may be applied to the exposed portion of the first layer of adhesive prior to use. The exposed portion of the first layer of adhesive 46 may be used to secure the front and rear panels together as previously described and to create indicia perceptible external to the bag if the bag is opened after being secured. A single sided pressure sensitive adhesive closure strip is advantageous in that it is less expensive than a double sided adhesive closure strip.

The layer of adhesive must adhere more aggressively to the layer of low adhesion material that the layer of low adhesion material adheres to the film backing strip.

Figure 13:
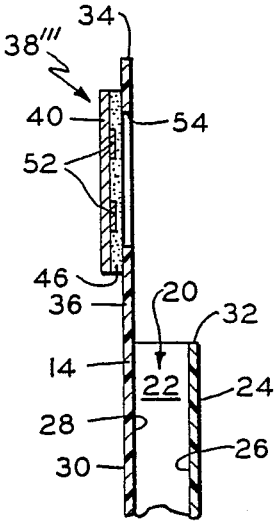
FIG. 13 is a cross sectional view of a portion of a security deposit bag with yet another alternate embodiment of the closure strip adhered to the back surface of the rear panel and with a portion of the adhesive surface of the closure strip exposed through an aperture in the rear panel.
Figure 14:
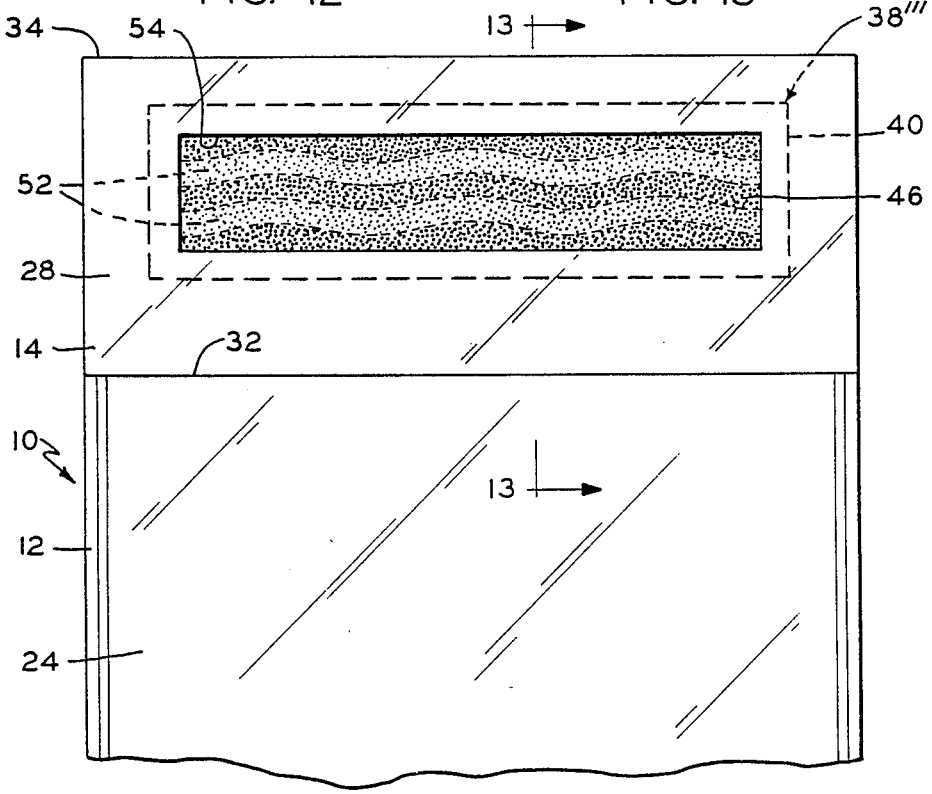
FIG. 14 is a front view of the security deposit bag of FIG. 13.

FIGS. 13 and 14 illustrate yet another alternate embodiment of the security deposit bag of this invention in which closure 38''', similar to that shown in FIG. 12, is adhered to rear surface 30 of the rear panel 14. A pattern of low adhesion material 52 is formed in the first layer of adhesive 46. Opening 54 is formed in the flap 36 portion of the rear panel 14. The closure strip 38''' is arranged so that the pattern of low adhesion material coincides with the opening 54. Although not shown, a removable liner may be applied to the exposed portion of the first layer of adhesive 46 on the front surface 28 of the rear panel prior to use. Indicia are formed when the pattern of low adhesion material 52 is delaminated from the film backing strip 40 along with a portion of the layer of adhesive 46 substantially in alignment with the pattern of low adhesion material. The closure strip may be used to resecure the front and rear panels together, as previously described. In addition, the relative strengths of adhesion are as described with respect to the embodiments shown in FIG. 12.

The following examples of closure strips constructed according to this invention are but a few of the many possible embodiments. Security Deposit Bags comprising closure strips, as illustrated in referenced figures, are further examples of embodiments of this invention.

EXAMPLE NO. 1
(AS SHOWN IN FIG. 2)

| FILM BACKING STRIP | PATTERN COATED LOW ADHESION MATERIAL | FIRST LAYER OF ADHESIVE | PARTS BY WEIGHT | SECOND LAYER OF ADHESIVE | PARTS BY WEIGHT | LINER |
|---|---|---|---|---|---|---|
| Cellulose acetate film 0.0016" thick. Second major surface is matte finished. | "Elvanol 85-82" Trade Name of DuPont for polyvinyl alcohol (99.8%) "Phorwite AR", Mobay Chemical, fluorescent dye (0.2%) Coating Weight About: 1.3 gm/m$^2$ | "Solprene 1205 Trade Name of Housemex, Inc. for styrene butadiene block copolymer | 75 | Copolymer Isooctyl-acrylate (94.5%) and acrylic acid (5.5%) | 100 | Two-sided silicone coated paper |
| | | "Kraton 1101, Trade Name of Shell Chemical for sytyrene, butadiene, block copolymer | 25 | "Foral 85" Trade Name of Hercules, Inc. for glycerol ester of hydrogenated rosin | 50 | |
| | | "Piccolyte A-135" Trade Name of Hercules, Inc. for polyterpene resin | 100 | "Stantone Color HCC-8523", Harwick, black color concentrate | 14 | |
| | | "Zonarez Alpha-25" Arizona Chemical Co. polyterpene resin | 88 | Coating weight: about 42 gm/m$^2$ | | |
| | | "Shellflex 371N" Shell Chemical Plasticizing Oil | 20 | | | |
| | | "330 antioxidant" Ethyl Corp. "Coating Weight about 50 gm/m$^2$ | 2 | | | |

EXAMPLE NO. 2
(AS SHOWN IN FIG. 2)

| FILM BACKING STRIP | PATTERN COATED LOW ADHESION MATERIAL | FIRST LAYER OF ADHESIVE | PARTS BY WEIGHT | SECOND LAYER OF ADHESIVE | PARTS BY WEIGHT | LINER |
|---|---|---|---|---|---|---|
| "RX-245" high density poly-ethylene from Consolidated Thermoplastics 0.0029" thick. Second major surface is matte finish | "PVP K-60 SOL" identity of polyvinylpyrrolido ne made by GAF Corp. Coating Weight About: 2.5 gm/m$^2$ | "Vistanex MML-120" Trade Name of Exxon Corp. for polyisobutylene | 100 | Copolymer of Isooctyl-acrylate (96%) and acrylamid (4%) | 100 | Two-sided silicone coated paper |
| | | "Hercotac RT-400" Trade Name of Hercules, Inc. for modified aromatic resin | 50 | "Nirez 2019" Trade Name of Reichold for terpene phenolic resin | 30 | |
| | | "Zonarez A-25" Arizona Chemical Co. polyterpene resin | 75 | "C.I. Pigment Green 7" from Chemetron Coating weight: about 50 gm/m$^2$ | 0.67 | |
| | | "Zona Alpha 100", Arizona Chemical, polyterpene resin | 55 | | | |
| | | "Vistanex LM-MH", Exxon Corporation Polyisobutylene "Coating Weight about 37 gm/m$^2$ | 50 | | | |

EXAMPLE NO. 3
(AS SHOWN IN FIG. 2 BUT WITH THE CLOSURE STRIP ADHERED TO THE FRONT SURFACE OF THE FRONT BAG PANEL

| FILM BACKING STRIP | PATTERN COATED LOW ADHESION MATERIAL | FIRST LAYER OF ADHESIVE | PARTS BY WEIGHT | SECOND LAYER OF ADHESIVE | PARTS BY WEIGHT | LINER |
|---|---|---|---|---|---|---|
| "SCOTCHLAMP" Brand Optical Lighting Film, 3M Company name for 0.5 mm thick transparent plastic sheeting with 90° grooves on second major surface, the peaks and valleys 0.09 mm apart | "Klucel L" Trade Name of Hercules Inc. for hydroxypropyl cellulose<br><br>Coating Weight About: 5.5 gm/m$^2$ | "Solprene 1205 Trade Name of Housemex, Inc. for styrene butadiene block copolymer | 75 | Copolymer of isooctylacrylate (96%) and acrylamide (4%) | 100 | Two-sided silicone coated-paper |
| | | "Kraton 1101, Trade Name of Shell Company for sytyrene, butadiene, block copolymer | 25 | "Foral 85" Trade Name of Hercules, Inc. for glycerol ester of hydrogenated rosin<br><br>Coating weight: about 59 gm/m$^2$ | 36 | |
| | | "Piccolyte A-135" Trade Name of Hercules, Inc. for polyterpene resin | 100 | | | |
| | | "Zonarez Alpha-25" Arizona Chemical Co. polyterpene resin | 88 | | | |
| | | "Shellflex 371N", Shell Chemical Plasticizing Oil | 20 | | | |
| | | "Stantone Color HCC-8523", Harwick, black color concentrate | 22 | | | |
| | | "330 antioxidant" Ethyl Corp. Coating Weight about 41 gm/m$^2$ | 2 | | | |

EXAMPLE NO. 4
(AS SHOWN IN FIG. 7)

| FILM BACKING STRIP | PATTERN COATED LOW ADHESION MATERIAL | FIRST LAYER OF ADHESIVE | SECOND LAYER OF ADHESIVE | LINER |
|---|---|---|---|---|
| "SCOTCHPAR 2110" Trade Name of 3M Co. for transparent 1 mil polyethylene terephthalate film | None on Film Backing* | Same as for Example No. 3 | Same as for Example No. 3 | Two-sided silicone coated paper |

*The Pattern Coated Low Adhesion Material of this Example is coated on front surface 28 of rear bag panel and is as follows with Coating Weight about 0.94 gm/m$^2$:
Pts. by Wt: 82.4 "Klucel MF", tradename of Hercules, Inc. for hydroxypropyl cellulose
Pts. by Wt: 13.6 "Evanol 85-82", duPont, polyvinyl alcohol
Pts. by Wt: 4.0 Phorwite AR, Mobay Chemical Fluorescent Dye

EXAMPLE NO. 5
(AS SHOWN IN FIG. 10)

| FILM BACKING STRIP | PATTERN COATED LOW ADHESION MATERIAL | FIRST LAYER OF ADHESIVE | SECOND LAYER OF ADHESIVE | LINER |
|---|---|---|---|---|
| "RX-245" High Density Polyethylene from Consolidated Thermoplastics 0.0029" Thick. Second major surface is matte finished. | Same as for Example No. 3 except:<br><br>Coating Weight: about 1.2 gm/m$^2$ | The shiny side of the Film Backing serves as heat activated adhesive | Same as for Example No. 3 | One side silicone coated paper |

EXAMPLE NO. 6
(AS SHOWN IN FIG. 11)

| FILM BACKING STRIP | PATTERN COATED LOW ADHESION MATERIAL | FIRST LAYER OF ADHESION | SECOND LAYER OF ADHESION | PARTS BY WEIGHT | LINER |
|---|---|---|---|---|---|
| Same as for Example No. 1 | Same as for Example No. 3 except: Coating Weight About: 1.3 gm/m$^2$ | Same as for Example No. 3 | Copolymer Isooctyl-acrylate (94.5%) and acrylic acid (5.5%) | 100 | Two-sided silicone coated paper |
| | | | "Foral 85" Trade Name of Hercules, Inc. for glycerol ester of hydrogenated rosin Coating weight: about 24 gm/m$^2$ | 50 | |

EXAMPLE NO. 7
(AS SHOWN IN FIGS. 12 AND 13)

| FILM BACKING STRIP | PATTERN COATED LOW ADHESION MATERIAL | FIRST LAYER OF ADHESIVE | SECOND LAYER OF ADHESIVE | PARTS BY WEIGHT | LINER |
|---|---|---|---|---|---|
| Same as for Example No. 1 | Same as for Example No. 1 | None Single Coated | "Vistanex MML-120" Trade Name for Exxon Corp. for polyisobutylene | 100 coated paper | 1 side or 2 side silicone |
| | | | "Hercotac RT-400" Trade Name of Hercules, Inc. for modified aromatic resin | 50 | |
| | | | "Zonarez A-25" Arizona Chemical Co. polyterpene resin | 75 | |
| | | | "Zona Alpha 100", Arizona Chemical, polyterpene resin | 56 | |
| | | | "C.I. Solvent Red 26" from Passaic Color | 1.4 | |
| | | | "Coating Weight about 24 gm/m$^2$ | | |

Yet another alternative embodiment that is not illustrated, is one in which the film backing strip 40 is formed from a thermoplastic adhesive such as polyethylene. In such a case, the film backing strip may be bonded directly to as bag panel and the first layer of adhesive omitted. The closure strip may be initially adhered by heat bonding the thermoplastic film backing strip to either bag panel for securement against the bag panel of a bag, or the closure strip may be initially secured by the first layer of adhesive 46 to a bag panel for securement to the other bag panel. The light transmissive properties of the various portions of the closure strip and the bag would be altered accordingly to enable external visual perception of the indicia.

A closure strip (not shown) may also be applied to opposing inside surfaces of the front and rear panels adjacent the opening of the bag. In such a configuration, at least a portion of the front or rear panels must be light transmissive for external perception of indicia. The flap may be omitted from the rear panel in such a case. It is only essential that the closure strip be utilized to secure the front panel to the rear panel to enclose the opening.

Alternatively, the closure strip may be applied to the front surface 28 of the rear panel 14 in the interior of the bag and the flap 36 omitted. Also, the closure strip 38 may be adhered to the rear surface 26 of the front panel 12 for securement to the front surface 28 of the rear panel 14; or the closure strip may be applied to the front surface 24 of the front panel 12 for securement to the front surface 28 of the flap portion 36 of the rear panel 14, in the illustrated embodiments, without altering the functioning of the invention as herein described.

The adhesive closure means, forming part of this invention incorporating tamper indicating means, may be utilized on any container, such as bottles, boxes or the like, to adhesively secure container parts together and provide an unambiguous indication that the container was sealed and reopened. However, in all other respects, the adhesive closure means is as herein described.

The present invention has now been described with reference to multiple embodiments thereof. It will be apparent to those skilled in the art that many changes can be made in the embodiments described without departing from the scope of the present invention. Thus the scope of the present invention should not be limited to the structures described in this application, but only by structures described by the language of the claims and the equivalents of those structures.

We claim:

1. A security deposit bag for receipt of articles, comprising:

(a) a first panel and a second panel, said panels being joined to form sides and a bottom of the bag, and the bag having an opening providing access to an interior of the bag;

(b) adhesive closure means adhered to said first panel and adapted to secure said panels together to close the opening of the bag;

(c) said adhesive closure means including tamper indicating means having a layer of low adhesion material applied in intimate surface to surface contact with one of said first panel, said second panel and said adhesive closure means for creating indicia visually perceptible externally of the bag after said adhesive closure means has adhesively secured said panels together and said panels are separated to open the bag.

2. The security deposit bag of claim 1, wherein said adhesive closure means comprises:

(a) an adhesive layer adhered to said first panel and adapted to adhere said panels together; and (b) said layer of low adhesion material of said tamper indicating means is applied in intimate surface to surface contact in a predetermined pattern on said first panel in between said first panel and said layer of adhesive;

(c) said layer of adhesive adhering more aggressively to said second panel when adhered thereto than said layer of low adhesion material adheres to said first panel;

(d) said layer of adhesive adhering more aggressively to said layer of low adhesion material than said layer of low adhesion material adheres to said first panel;

(e) so that when said first and second panels are adhered together by said adhesive closure means and then separated, said layer of low adhesion material is delaminated from said first panel along with at least a portion of said layer of adhesive substantially in alignment with said layer of low adhesion material forming indicia visibly perceptible externally of the bag in the form of said pattern.

3. The security bag of claim 2, wherein said layer of low adhesion material is capable of readhering to said first panel in intimate surface to surface contact when said first and second panels are resecured together by said adhesive closure means.

4. The security deposit bag of claim 2, wherein said first panel includes a surface adapted to enhance the visibility of said indicia when said first and second panels are resecured together by said adhesive closure means after said indicia are formed.

5. The security deposit bag of claim 1, wherein said adhesive closure means comprises:

(a) a film backing strip;

(b) an adhesive layer adhered to said film backing strip for adhering said film backing strip to said first panel with a portion of said layer of adhesive exposed and adapted to adhere said first panel to said second panel; and (c) said layer of low adhesion material of said tamper indicating means is applied in intimate surface to surface contact in a predetermined pattern on said film backing strip in between said film backing strip and said layer of adhesive;

(d) said layer of adhesive adhering more aggressively to said layer of low adhesion material than said layer of low adhesion material adheres to said film backing strip;

(e) said layer of adhesive adhering more aggressively to said first panel and said second panel when adhered thereto than said layer of low adhesion material adheres to said film backing strip;

(f) so that when said first and second panels are adhered together by said adhesive closure means and then separated, said pattern of low adhesion material is delaminated from said film backing strip along with at least a portion of said layer of adhesive substantially in alignment with said layer of release material, said layer of low adhesion material forming indicia visibly perceptible externally of the bag in the form of said pattern.

6. The security deposit bag of claim 5, wherein said layer of low adhesion material is incapable of readhering to said film backing strip in intimate surface to surface contact when said first and second panels are resecured together by said adhesive closure means.

7. The security deposit bag of claim 5, wherein said film backing strip includes a surface adapted to enhance the visibility of said indicia when said first and second panels are resecured together by said adhesive closure means after said indicia are formed.

8. The security deposit bag of claim 1, wherein said adhesive closure means comprises:

(a) a film backing strip having first and second major surfaces;

(b) a first layer of adhesive adhered to said first major surface and adhering said closure trip to said first panel;

(c) a second layer of adhesive adhered to said second major surface of said film backing strip adapted to adhere said closure strip to said second panel;

(d) said layer of low adhesion material of said tamper indicating means is applied in intimate surface contact to said second major surface of said film backing strip in a predetermined pattern in between said film backing strip and said second layer of adhesive;

(e) said first layer of adhesive adhering more aggressively to said first panel and said first major surface of said film backing strip than said second layer of adhesive adheres to said second panel or to said second major surface of said film backing strip;

(f) said second layer of adhesive adhering more aggressively to said layer of low adhesion material than said layer of low adhesion material adheres to said second major surface of said film backing strip;

(g) so that when said first and second panels are adhered together by said adhesive closure means and then separated, said pattern of low adhesion material is delaminated from said second major surface of said film backing strip along with at least a portion of said second layer od adhesive substantially in alignment with said layer of release material, said layer of low adhesion material forming indicia visibly perceptible externally of the bag in the form of said pattern.

9. The security deposit bag of claim 8, wherein said layer of low adhesion material is incapable of readhering to said second major surface of said film backing strip in intimate surface to surface contact when said first and second panels are resecured together by said adhesive closure means.

10. The security deposit bag of claim 8, wherein said first panel includes a surface adapted to enhance the visibility of said indicia when said first and second panels are resecured together by said adhesive closure means after said indicia are formed.

11. The security deposit bag of claim 1, wherein said adhesive closure means comprises:

(a) a film backing strip having first and second major surfaces;

(b) a first layer of adhesive adhered to said first major surface and adhering said film backing strip to said first panel;

(c) a second layer of adhesive adhered to said second major surface of said film backing strip and adapted to adhere said closure strip to said second panel;

(d) said layer of low adhesion material of said tamper indicating means is applied in intimate surface to surface contact to said first panel in a predetermined pattern in between said first panel and said first layer of adhesive;

(e) said second layer of adhesive adhering more aggressively to said second panel and said second major surface of said film backing strip than said first layer of adhesive adheres to said first panel or said first major surface of said film backing strip;

(f) said major layer of adhesive adhering to said first major surface of said film backing strip more aggressively than said layer of low adhesion material adheres to said first panel;

(g) so that when said first and second panels are adhered together by said adhesive closure means and then separated, said pattern of low adhesion material is delaminated from said first panel along with at least a portion of said first layer of adhesive substantially in alignment with said layer of release material, said layer of low adhesion material forming indicia visibly perceptible externally of the bag in the form of said pattern.

12. The security deposit bag of claim 11, wherein said layer of low adhesion material is incapable of readhering to said first panel in intimate surface to surface contact when said first and second panels are resecured together by said adhesive closure means.

13. The security deposit bag of claim 11, wherein said first panel includes a surface adapted to enhance the visibility of said indicia when said first and second panels are resecured together by said adhesive closure means after said indicia are formed

14. The security deposit bag of claim 1, wherein said indicia includes alphanumeric characters.

15. For use with a container for receipt of articles, the container including first and second container portions and an opening providing access to an interior of the container, the first and second container portions closing the opening when secured together, an adhesive closure strip adapted to adhesively secure the first and second container portions together to close the opening of the container and including tamper indicating means having a layer of low adhesion material applied in intimate surface contact with one of the first container portion, the second container portion, and said adhesive closure strip for creating indicia visually perceptible externally of the container after the adhesive closure strip has adhesively secured the container portions together and the container portions are separated to open the container.

16. The adhesive closure strip of claim 15, wherein the adhesive closure strip further comprises:

(a) an adhesive layer adapted to be adhered to the first container portion and adapted to adhere the first and second container portions together; and (b) said layer of low adhesion material of said tamper indicating means is adapted to be applied in intimate surface to surface contact in a predetermined pattern on the first container portion in between the first container portion and said layer of adhesive;

(c) said layer of adhesive adapted to, adhere more aggressively to the second container portion when adhered thereto than said layer of low adhesion material adheres to the first container portions when adhered thereto;

(d) said layer of adhesive adhering more aggressively to said layer of low adhesion material than said layer of low adhesion material adheres to the first container portion when adhered thereto;

(e) so that when the first container portion and the second container portion are adhered together by the adhesive closure strip and then separated, said layer of low adhesion material is delaminated from the first container portion along with at last a portion of said layer of adhesive substantially in alignment with said layer of low adhesion material, said layer of low adhesion material forming indicia visibly perceptible externally of the container in the form of said pattern.

17. The adhesive closure strip of claim 15, wherein the adhesive closure strip further comprises:

(a) a film backing strip;

(b) a layer of adhesive adhered to said film backing strip and adapted to said film backing strip to the first container portion with a portion of said layer of adhesive exposed and adapted to adhere the first container portion to the second container portion; and (c) said layer of low adhesion material of said tamper indicating means is applied in intimate surface to surface contact in a predetermined pattern on said film backing strip in between said film backing strip and said layer of adhesive;

(d) said layer of adhesive adhering more aggressively to said layer of low adhesion material than said layer of low adhesion material adheres to said film backing strip;

(e) said layer of adhesive adhering more aggressively to the first container portion and the second container portion when adhered thereto, than said film backing strip;

(f) so that when the first container portion and second container portion are adhered together by said adhesive closure strip and then separated, said pattern of low adhesion material is delaminated from said film backing strip along with at least a portion of said layer of adhesive substantially in alignment with said layer of release material, said layer of low adhesion material forming indicia visibly perceptible externally of the container in the form of said pattern.

18. The adhesive closure strip of claim 15, wherein the adhesive closure strip further comprises:

(a) a film backing strip having first and second major surfaces;

(b) a first layer of adhesive adhered to said first major surface and and adapted to adhere the adhesive closure strip to the first container portion;

(c) a second layer of adhesive adhered to said second major surface of said film backing strip and adapted to adhere said closure strip to the second container portion;

(d) said layer of low adhesion material of said tamper indicating means is applied in intimate surface to surface contact to said second major surface of said film backing strip in a predetermined pattern in between said film backing strip and said second layer of adhesive;

(e) said first layer of adhesive adapted to adhere more aggressively to the first container portion when adhered thereto and said first major surface of said film backing strip than said second layer of adhesive adheres to the second container portion when adhered thereto or to said second major surface of said film backing strip;

(f) said second layer of adhesive adhering more aggressively to said layer of low adhesion material than said layer of low adhesion material adheres to said second major surface of said film backing strip;

(g) so that when the first container portion and second container portion are adhered together by the adhesive closure strip and then separated, said pattern of low adhesion material is delaminated from said second major surface of said film backing strip along with at least a portion of said second layer of adhesive substantially in alignment with said layer of release material, said layer of low adhesion material forming indicia visibly perceptible externally of the container in the form of said pattern.

19. The adhesive closure strip of claim 15, further comprising:

(a) a film backing strip having first and second major surfaces;

(b) a first layer of adhesive adhered to said first major surface and adapted to adhere said film backing strip to the first container portion;

(c) a second layer of adhesive adhered to said second major surface of said film backing strip and adapted to adhere the adhesive closure strip to the second container portion;

(d) said layer of low adhesion material of said tamper indicating means is adapted to be applied in intimate surface to surface contact to the first container portion in a predetermined pattern in between the first container portion and said first layer of adhesive;

(e) said second layer of adhesive adhering more aggressively to the second container portion when adhered thereto and said second major surface of said film nacking strip than said first layer of adhesive adheres to the first container portion when adhered thereto or said first major surface of said film backing strip;

(f) said first layer of adhesive adhering to said first major surface of said film backing strip more aggressively than said layer of low adhesion material adheres to the first container portion when adhered thereto;

(g) so that when the first container portion and the second container portion are adhered together by the adhesive closure strip and then separated, said pattern of low adhesion material is delaminated from the first container portion along with at least a portion of said first a layer of adhesive substantially in alignment with said layer of release material, said layer of low adhesion material forming indicia visibly perceptible externally of the container in the form of said pattern.

20. The security deposit bag of claim 2, wherein said layer of adhesive adheres more aggressively to said first panel than to said second panel.

21. The adhesive closure strip of claim 16 wherein said layer of adhesive is adapted to adhere more aggressively to the first container portion than to the second container portion.

* * * * *

UNITED STATES PATENT AND TRADEMARK OFFICE

CERTIFICATE OF CORRECTION

PATENT NO. : 4,838,708

DATED : June 13, 1989

INVENTOR(S) : Bruce A. Holcomb, Shaun D. McCracken, and Bryan J. McGinnis

It is certified that error appears in the above-identified patent and that said Letters Patent is hereby corrected as shown below:

Col. 2, line 42, insert --front-- before the word "panel".
Col. 5, line 59, "don'oincide" should read --don't coincide--.
Col. 6, line 21, "adhere" should read --readhere--.
Col. 6, line 36, "!4" should read --14--.
Col. 8, line 63, "that" should read --than--.
Col. 11, line 15, "Company" should read --Chemical--.

Col. 13 & 14, line 4, in heading of Tables 3&4, word "Adhesion" should read --Adhesive--.

Col. 14, line 23, "for" should read --of--.
Col. 14, Column 5, line 23, delete the words [coated paper].
Col. 14, Column 6, line 23, insert the words --coated paper--.

Col. 15, line 40, insert after the word "material" --, said layer of low adhesion material--.

Col. 15, line 43, "capable" should read --incapable--.

UNITED STATES PATENT AND TRADEMARK OFFICE

CERTIFICATE OF CORRECTION

PATENT NO. : 4,838,708

DATED : June 13, 1989

INVENTOR(S) : Bruce A. Holcomb, Shaun D. McCracken, and Bryan J. McGinnis

It is certified that error appears in the above-identified patent and that said Letters Patent is hereby corrected as shown below:

Col. 16, line 37, before the word "contact", insert the words --to surface--.

Col. 16, line 55, "od" should read --of--.

Col. 17, line 23, replace the word [major] with the word --first--.

Col. 18, line 30, insert the word --adhere-- before the word "said".

Col. 18, line 46, insert the words --layer of low adhesion material adheres to said-- before the word "film".

Col. 20, line 12, "nacking" should read --backing--.
Col. 20, line 26, delete the word [a].

Signed and Sealed this

Twenty-fourth Day of July, 1990

*Attest:*

HARRY F. MANBECK, JR.

*Attesting Officer*

*Commissioner of Patents and Trademarks*